United States Patent [19]

Barbour

[11] 4,401,029

[45] Aug. 30, 1983

[54] CREDIT CARD IMPRINTER WITH CARD-SENSING FORM INSERTION INTERLOCK

[75] Inventor: William P. Barbour, Crystal Lake, Ill.

[73] Assignee: DBS, Inc., Randolph, Mass.

[21] Appl. No.: 334,281

[22] Filed: Dec. 24, 1981

[51] Int. Cl.[3] ..... B41F 3/04

[52] U.S. Cl. ..... 101/269; 101/45

[58] Field of Search ..... 101/45, 56, 269-274, 101/407 BP

[56] References Cited

U.S. PATENT DOCUMENTS

| | | | |
|---|---|---|---|
| 3,283,711 | 11/1966 | Lew | 101/269 |
| 3,654,862 | 4/1972 | Strohschneider | 101/269 |
| 3,818,828 | 6/1974 | Nakada et al. | 101/269 |
| 3,983,802 | 10/1976 | Thomson et al. | 101/269 |
| 4,059,051 | 11/1977 | Maul et al. | 101/45 |

*Primary Examiner*—Edward M. Coven

*Attorney, Agent, or Firm*—Gerald J. Ferguson, Jr.; Joseph J. Baker

[57] ABSTRACT

A data recorder for imprinting credit card data on to paper sales forms for credit card transactions. The recorder includes a printing bed and a platen mounted for movement across the bed, whereby, when the card and form are in position on the bed, a roller on the platen moves over indicia on the card so transferring the data to the form. A lever is pivotally mounted and has two fingers projecting through apertures in the bed. When a card is correctly positioned the lever is pivoted so that the fingers are retracted whereby a form can be correctly positioned without disturbance upon movement of the platen. When the card is not correctly positioned, the lever is biased so that the fingers stand proud of the bed whereby movement of the platen displaces the form.

12 Claims, 5 Drawing Figures

FIG. 1
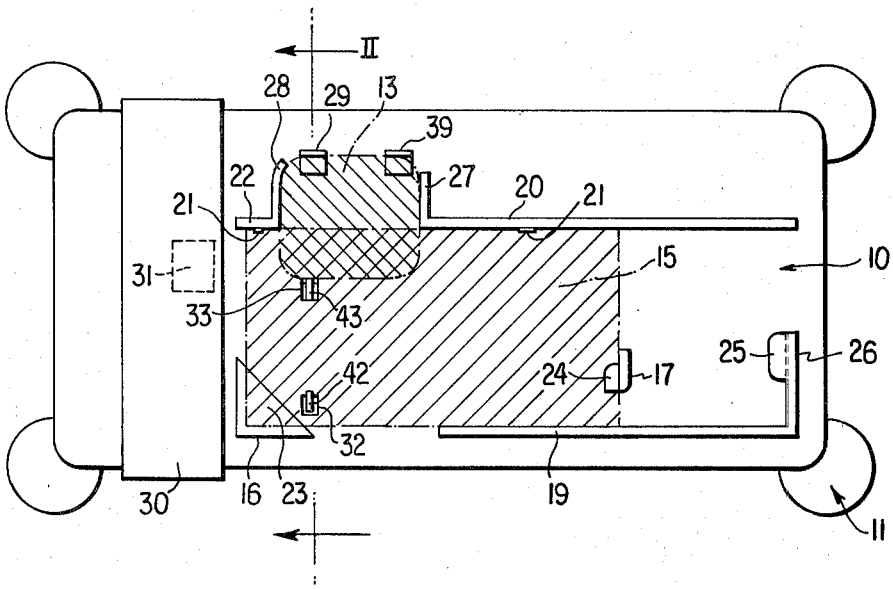
FIG. 2
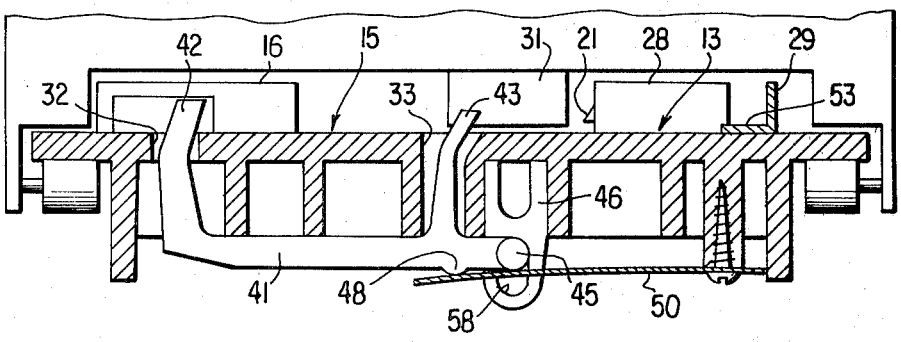
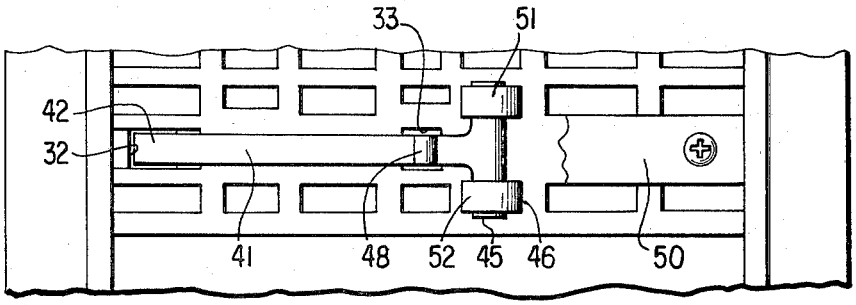
FIG. 3

CREDIT CARD IMPRINTER WITH CARD-SENSING FORM INSERTION INTERLOCK

BACKGROUND OF THE INVENTION

The present invention relates to a data recorder for imprinting credit card data onto paper sales forms for credit card transations.

In the use of credit card imprinters it has been found that a percentage of clerks fail to insert the credit card before making a transation. As a result, the credit transaction fails to identify the purchaser and the merchant makes a loss.

A means of discouraging this practice is in current use which restricts the print head or platen from moving out of its parked position if a credit card is not in its correct imprinting located on the data recorder.

This system has the disadvantage that since it involves a mechanical block it invites breakage, which is particularly likely to occur when the mechanism is employed in the light weight, inexpensive types of imprinters in common use in retail stores.

SUMMARY OF THE INVENTION

In the present invention, failure to insert the credit card leaves a preferably brightly coloured obstruction in a position which prevents insertion of the paper sales form. Upon insertion of the credit card into its correct location the obstruction to the insertion of the form is removed.

The advantages to the present invention are that machine reliability is greatly improved because inadvertent forcing of the print head mechanism is eliminated and because the invention can be put into practice with a very simple mechanism which is ultra simple, involving only one moving part which at no time is subjected to undue force.

According to the present invention a data recorder has a printing bed and a printing platen mounted for movement across the bed, whereby information may be transferred from a card to a form, the bed having stop means and form displacement means being located adjacent the stop and retractably mounted relative to the bed and normally biased into a print preventing position in which they displace the form into the path of the platen and retractable into a print permitting position where the form can rest out of the path of the platen, the said retraction being occasioned by location of the credit card in the correct position on the printing bed.

In a preferred form of the invention the bed preferably defines a card holding region and a form holding region which partly overlap with each other, whereby a card carrying embossed indicia when located in the card holding region will have its indicia in the overlapping region and a form, when located in the form holding region, will have a space on which the said indicia can be caused to imprint, thereby transferring information from the card to the form, the stop being located in the form holding region. The platen preferably carries a printing roller adapted to press the form against the indicia on the card when the platen is slid across the bed.

The form displacement means preferably comprise a form engaging finger extending up through the top surface of the bed, a card engaging finger preferably also extends up through the top surface of the bed and is located so as to be pivotable from a position in which its card engaging edge is just inside the card holding region to one where it is at the edge of the card holding region in which position it causes the form engaging finger to be retracted to a print permitting position.

The fingers are preferably mounted on a common lever which is pivoted by a pivot on an extension of the lever beyond the card engaging finger remote from the form engaging finger. The common lever is preferably pivoted in a holder attached to the underside of the print bed and the fingers extend up through apertures in the printing bed.

Preferably at least the aperture in which the card engaging finger is located is chamfered at least at its upper edge on at least that edge nearest the card holding region.

The pivot preferably involves lost motion. This has the advantage that mere vertical depression of the card engaging lever as by depression by the roller (in the absence of the card) is taken up by the lost motion which prevents pivoting and this causes merely the same depression of the form engaging finger and not pivoted retraction of that finger. Thus, the holder preferably has a slot elongated transverse to the surface of the printing bed so that the lever pivots about an axis parallel to the surface of the printing bed.

The fingers are preferably cranked towards the card holding region. Thus on pivoting they still face upwardly and moreover do not snag the apertures. The end of the fingers are preferably chamfered so as to be approximately parallel to the surface of the printing bed.

BRIEF DESCRIPTION OF THE DRAWINGS

FIG. 1 is a plan view of the data recorder from above;

FIG. 2 is a partial section view along the line II—II of FIG. 1;

FIG. 3 is a partial plan view from below of the same region shown in FIG. 2;

DESCRIPTION OF THE PREFERRED EMBODIMENT

Figure 4:
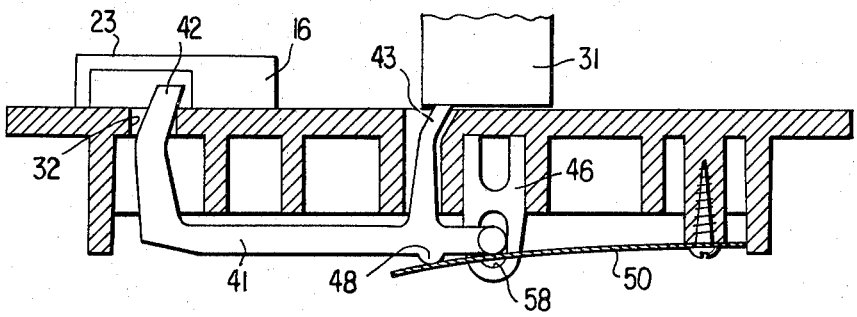
FIG. 4 is a view, similar to FIG. 2, of the recorder in operation without a credit card in position.

FIG. 1 shows a data recorder with a data recorder bed 10 having a short leg at each corner. Each leg carries a rubber suction pad 11 to enable the recorder to be held firmly in position on the surface on which it is to be used. The data recorder bed 10 is adapted to hold a credit card and a transaction record form in predefined relationship so that the account number on the card can be imprinted onto the correct location on the form. To this end the bed 10 has a card holding region 13 and form holding region 15 which partly overlap, as can be seen from the cross hatching in FIG. 1.

The form holding region is defined by form stops 16, 17 arranged to hold the form against lengthways movement on the bed during imprinting and side wall stops 19 and 20 arranged to hold the form against sideways movement. The wall 20 extends as a further portion 22 beyond the card holding region 13 and at both sides is provided with inwardly extending lips 21 under which the form must be inserted and which then hold it in place flat on the bed 10.

In similar manner the stops 16 and 17 are shaped so as to afford lips 23 and 24 beneath which the form must be inserted. If a longer form is being used it can be laid over the stop 17 and inserted beneath the lip 25 of the stop 26.

The credit card holding region 13 is defined by outwardly turned ends 27 and 28 of the walls 20 and 22 and by outer stops 29 and 30. The bed 10 is slightly built up at 53 adjacent the stops 29 and 39 so as to facilitate removal of the card after use by the operator.

A platen 30 is mounted for sliding movement across the face of the bed 10 parallel to the walls 19 and 20. The platen 30 carries a roller 31 arranged to printingly engage the overlapping area common to the regions 13 and 15 and thus imprint embossed indicia (e.g. the credit card number) onto the form.

A source of loss in credit card transactions is when a form is apparently embossed but the card was not inserted in the recorder. The account number is thus not transferred to the form and the goods change hands without a record of the new possessor of them being made.

The present invention aims to prevent this occurring by arranging that unless a credit card is correctly located in the region 13 the form will not be retained in the region 15 (and thus imprinted) when the platen 30 is slid across the bed.

To this end the recorder is arranged to displace the form into the path of the platen (which thus sweeps it out of the way) by means of a finger which extends above the surface of the bed 10 but is retractable into the bed under the agency of means which are engaged by the credit card when it is correctly located in the region 13.

Thus the bed 10 has two apertures 32 and 33 extending through it and positioned opposite each other on either side of the bed 10, one 32 being adjacent the stop 16 and the other 33 being contiguous or nearly so to the region 13. Mountred below the bed 10 (as shown in FIGS. 2 and 3) is the form displacing mechanism 40. This consists of an interlock lever 41 which has a pair of cranked fingers 42 and 43 projecting through the apertures 32 and 33, respectively as shown in FIGS. 2 and 3, the cranking being towards the region 13.

It will be observed that the edge of the aperture 33 which faces towards the region 13 is chamfered so as to accommodate the cranking of the finger 43. The lever has a fulcrum in the form of a spindle 45 which runs transverse to the card interlock lever 41. The lever 41 is mounted on the recorder by means of a holder 46 which has two legs 51, 52 and which is secured to the underside of the bed 10. Each end of the spindle 45 is mounted in elongated round ended slots 58 formed in the legs 51 and 52 of the holder. The slot has its axis transverse to the bed 10. The lever 41 has a boss or abutment 48 on its lower face below the finger 43.

A leaf spring 50 is attached to the underside of the bed 10 beneath the region 13. Its free end passes between the legs 51 and 52 of the holder 46 and the spring presses against the abutment 48 on the underside of the lever 41.

The spring biases the interlock lever 41 upwardly so that the fingers 42 and 43 project through the bed 10.

The shape of the lever 41 and its mode of mounting and biased result in the way in which the finger 43 is depressed causing the way in which the finger 42 is retracted to be significantly different. Thus if the finger 43 is depressed by pressure applied to its top surface, e.g. by the roller 31, the finger 42 is only retracted slightly as shown in FIG. 4.

Figure 5:
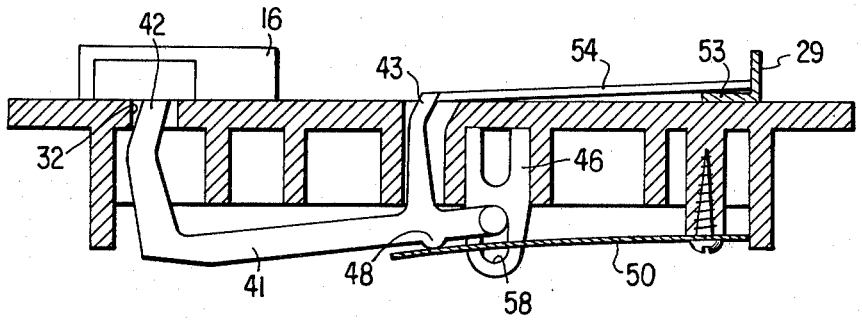
FIG. 5 is a view, similar to FIG. 2, of the recorder in operation with a credit card correctly in position.

However, if the side face of the finger 43 is pushed away from the region 13 as by being engaged by a credit card 54, then the finger 43 is substantially retracted as shown in FIG. 5.

Thus in the position shown in FIG. 4 the finger 42 projects up above the top surface of the bed 10 to such an extent as to make it extremely difficult to insert the form under the lip 23 of the stop 16 and impossible to do so accidentally. (If desired the relative positions of the finger 42 and the stop 16 could be made closer together, e.g. by offsetting the finger 42 on the lever 41 or by moving the whole lever 41 towards the stop 16 or vice versa).

The form thus will project up into the path of the platen 30 and be swept aside by it when imprinting is attempted in the absence of the credit card.

However, as shown in FIG. 5, when the credit card is in place the finger 42 is retracted much further and permits the form readily to be inserted under the lip 23 so that proper imprinting will occur.

Obviously, numerous modifications and variations of the present invention are possible on the light of the above teachings. It is therefore to be understood that within the scope of the appended claims, the invention may be practiced otherwise that as specifically described herein.

What I claim as my invention and desire to secure by Letters Patent is:

1. A data recorder for imprinting data from a credit card to a form, said recorder comprising a printing bed and a printing platen mounted for movement across said bed, said bed being adapted to receive said card and said form in a printing location whereby movement of said platen across said printing location causes information to be transferred from said card to said form, said bed including card sensing means for sensing the presence or absence of said card in said printing location and form displacement means responsive to said card means sensing the absence of the card in the printing position for displacing the form away from the bed in the path of the platen when the platen is moved across the printing location so that the form is swept aside to thereby prevent imprinting of the data onto the form whenever the card is not present in the printing location.

2. The data recorder of claim 1 in which said printing location defines a card holding region and a form holding region which partly overlap each other, whereby a card carrying embossed indicia, when located in said card holding region, will have its indicia in said overlapping region, and said form, when located in said form holding region, will have a space on which said indicia can be caused to imprint, thereby transferring information from said card to said form.

3. The data recorder of claim 2 where card sensing means includes a card engaging finger means and said form displacement means includes a form engaging finger means coupled to said card engaging finger means and where said data recorder includes first and second apertures in said printing bed, biasing means for normally biasing said card engaging finger means and said form engaging finger means through the first and second apertures respectively, said card engaging finger means, in response to a card being present in the card holding region, being moved to a first position against the bias of said biasing means and sai bor& dngaging finger means being moved, due to its coupling to the card engaging finger means to a print permitting position where the form will remain in place when the platen is moved across the printing location to thereby permit imprinting of the data onto the form when the card is present in the card holding region, said card engaging finger means, in response to a card being absent from said card holding region, being maintained in a second position by said biasing means and said form engaging finger means being maintained, due to its coupling to the card engaging finger means, in a print preventing position where said form is displaced in the path of the platen when the platen is moved across the printing location.

4. The data recorder of claim 3 including form holding means for holding said form on said form holding region, said form holding means including at least one form stop for inhibiting movement lengthwise along the printing bed where said form step includes a lip under which the form is inserted, said second aperture being disposed adjacent said form stop means so that when said form engaging finger means is in its print preventing position, the form is displaced above the printing bed to a point where it is difficult to inert it under said lip.

5. The data recorder of claim 3 where said card engaging finger means is pivotally mounted between said second position in which a card engaging edge thereof is within said card holding region in response to a card being absent from said card holding region and said first position in which it is at the edge of said card holding region in response to a card being present in said card holding region.

6. The data recorder of claim 3 in which said finger means are both mounted on a common lever having an extension, the lever being pivotally mounted by pivot means located on the extension beyond said card engaging finger means and remote from said form engaging finger means.

7. A data recorder as claimed in claim 6 in which the said common lever is pivotally mounted in a holder attached to the underside of said printing bed.

8. The data recorder of claim 7 in which said holder has a slot elongated transverse to the surface of said printing bed by means of which said common lever pivots about an axis parallel to said surface of said printing bed.

9. The data recorder of claim 8 in which said holder comprises two legs, one on each side of said common lever, each of said legs having an elongate slot by means of which said common lever pivots.

10. The data recorder of claim 9 in which said finger means are cranked towards said card holding region, so that on pivoting said fingers still face upwardly and do not snag said apertures in said printing bed.

11. The data recorder of claim 6 in which said pivot means is mounted in a lost motion coupling, said lost motion being such that vertical depression of said card engaging finger means by said platen in the absence the said card in said card holding region is taken up by said lost motion thereby preventing pivoting of the form contacting finger means to said print permitting position about said pivot means but causing merely a depression of said form engaging finger means such that the form engaging finger means remains in the print preventing position.

12. The data recorder of any one of claims 5 to 10 and 3 including stop means for stopping said form engaging finger means at said print preventing means and said card engaging finger means at said first position and where the ends of both said finger means are chamfered so as to be approximately parallel to said surface of said printing bed when in said stopped positions.

* * * * *